US010472747B2

(12) United States Patent
Lai et al.

(10) Patent No.: US 10,472,747 B2
(45) Date of Patent: Nov. 12, 2019

(54) TEXTILE WITH CONDUCTIVE STRUCTURES

(71) Applicant: Far Eastern New Century Corporation, Taipei (TW)

(72) Inventors: Hsin-Kai Lai, Taipei (TW); Yu-Chun Wu, Taipei (TW); Wei-Che Hung, Taipei (TW)

(73) Assignee: Far Eastern New Century Corporation, Taipei (TW)

( * ) Notice: Subject to any disclaimer, the term of this patent is extended or adjusted under 35 U.S.C. 154(b) by 0 days.

(21) Appl. No.: 16/153,818

(22) Filed: Oct. 7, 2018

(65) Prior Publication Data

US 2019/0218695 A1 Jul. 18, 2019

(30) Foreign Application Priority Data

Jan. 18, 2018 (TW) ..... 107101856 A

(51) Int. Cl.

| | |
|---|---|
| ***D04B 1/14*** | (2006.01) |
| ***D04B 1/24*** | (2006.01) |
| ***D03D 1/00*** | (2006.01) |
| ***H01B 1/04*** | (2006.01) |
| ***H01B 1/02*** | (2006.01) |

(52) U.S. Cl.

CPC ..... *D04B 1/14* (2013.01); *D03D 1/0088* (2013.01); *D04B 1/24* (2013.01); *H01B 1/02* (2013.01); *H01B 1/04* (2013.01); *D10B 2401/16* (2013.01)

(58) Field of Classification Search

CPC ..... H05K 1/038; D03D 1/0088; D03D 2700/0166; A61B 5/6804

See application file for complete search history.

(56) References Cited

U.S. PATENT DOCUMENTS

| | | | | |
|---|---|---|---|---|
| 6,289,702 | B1 | 9/2001 | Heirbaut | |
| 6,346,491 | B1 * | 2/2002 | DeAngelis | B32B 5/26 442/110 |
| 6,915,668 | B2 | 7/2005 | Huang | |
| 2010/0279086 | A1 * | 11/2010 | Park | B32B 27/12 428/201 |

* cited by examiner

*Primary Examiner* — Hoa C Nguyen
*Assistant Examiner* — Amol H Patel
(74) *Attorney, Agent, or Firm* — Winston Hsu

(57) ABSTRACT

A textile with conductive structures includes a fabric substrate, an outer conductive structure made of polymer and disposed on the fabric substrate, and an inner conductive structure disposed under the outer conductive structure and electrically connected to the outer conductive structure. The sheet resistance of the inner conductive structure is lower than the sheet resistance of the outer conductive structure. The total sheet resistance of the inner and outer conductive structures is less than 100 ohms per square when the textile undergoes a laundery procedure.

10 Claims, 3 Drawing Sheets

TEXTILE WITH CONDUCTIVE STRUCTURES

BACKGROUND OF THE INVENTION

1. Field of the Invention

The present invention relates generally to a textile with conductive structures, and more particularly to a textile with conductive structures applicable to be worn on a human body.

2. Description of the Prior Art

Recently, there is a great demand for self-management (self-care) and long-distance health care. In order to fulfill the needs of instantly monitoring the physiological information of human bodies, the industries have proposed techniques to incorporate physiological sensing devices in wearable clothing. In this way, the physiological sensing devices may be used to instantly monitor the physiological information of the wearers for exercise or home care, and the demand for self-management can be fulfilled.

Generally, if a physiological sensing device is to be incorporated in wearable clothing, electrodes for measuring a physiological signal must be provided on the clothing. In the current technology, one approach is to have a pattern with conductive fibers woven on a fabric by weaving, and the conductive pattern is used as an electrode for measuring physiological signals. Another approach is to apply a conductive paste, such as a silver paste, on a fabric by coating to form an electrode for measuring physiological signals.

However, the above approaches still have drawbacks. For example, the technique of forming a conductive electrode by weaving, there are less contact points between the conductive electrode and the human body, and thus it is of the consequence that the physiological signals are not easily to be measured. In addition, the technique of forming a conductive electrode by coating, it is generally not washable and not durable although it can increase the contact points between the electrode and the human body.

Therefore, it is needed to propose a textile with conductive structures to overcome the drawbacks in the conventional techniques.

SUMMARY OF THE INVENTION

To this end, a textile with conductive structures is provided in order to overcome the drawbacks of the conventional techniques.

According to one embodiment of the present invention, a textile with conductive structures includes a fabric substrate, an outer conductive structure and an inner conductive structure. The composition of the outer conductive structure includes a polymer, and the outer conductive structure is disposed on the fabric substrate. The inner conductive structure is disposed under the outer conductive structure and electrically connected to the outer conductive structure. The sheet resistance of the inner conductive structure is lower than the sheet resistance of the outer conductive structure. In addition, the inner conductive structure and the outer conductive structure have a total sheet resistance. The total sheet resistance is less than 100 ohms per square after the textile undergoes a laundery procedure.

According to the above embodiment, the above textile has double-layer conductive structures, i.e. the inner conductive structures and the outer conductive structures, and the sheet resistance of the inner conductive structure is lower than the sheet resistance of the outer conductive structure. Since the outer conductive structure has a high proportion of polymer, the outer conductive structure is more resistant to a laundery procedure than the inner conductive structure. In other words, the outer conductive structure may serve as a protection layer of the inner conductive structure so that the structure and the electrical properties of the inner conductive structure are not deteriorated in a laundery procedure.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

For more complete understanding of the present invention and its advantage, reference is now made to the following description, taken in conjunction with accompanying drawings, in which.

DETAILED DESCRIPTION

The present disclosure is described by the following specific embodiments. Those with ordinary skill in the arts can practice the present disclosure after reading the disclosure of this specification. These various embodiments are disclosed with reference to the accompanying drawings to render the accompanying drawings part of the embodiments. The present disclosure can also be implemented with different embodiments. Various details described in this specification can be modified based on different viewpoints and applications without departing from the scope of the present disclosure.

Figure 1:
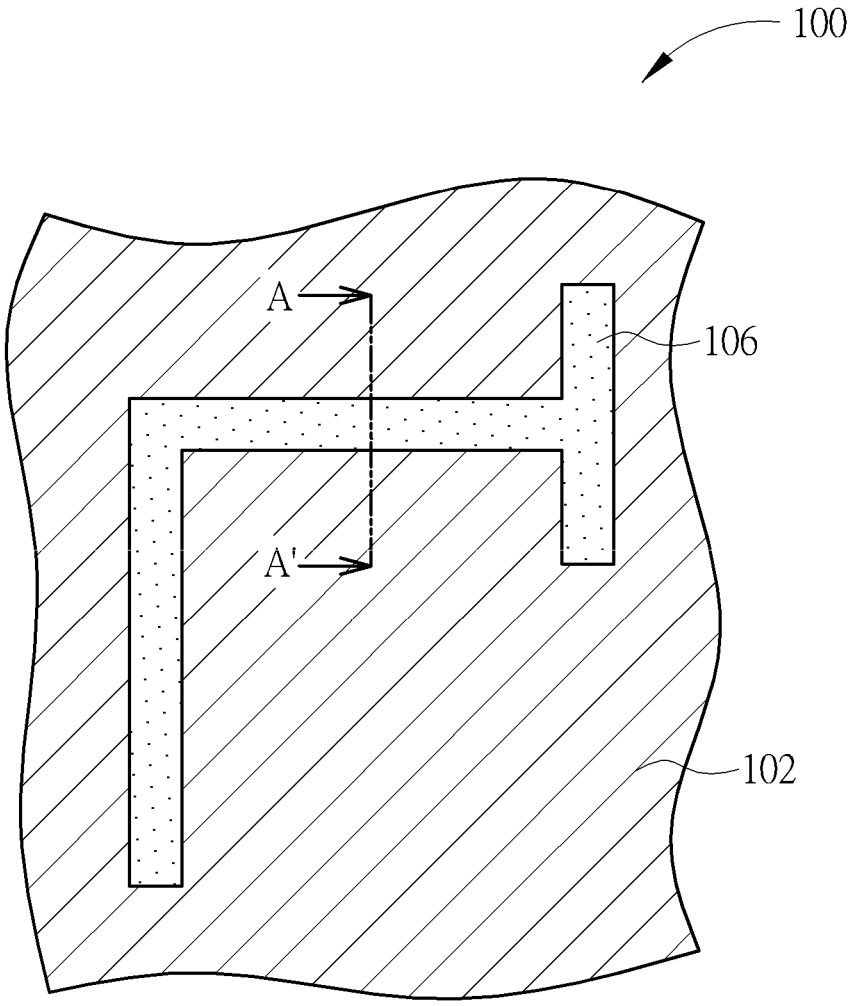
FIG. 1 is a top view of a textile with conductive structures in accordance with the first embodiment of the present invention.

FIG. 1 is a top view of a textile with conductive structures in accordance with the first embodiment of the present invention. As shown in FIG. 1, the textile 100 has a fabric substrate 102 and a conductive structure, i.e. an outer conductive structure 106. The outer conductive structure 106 is disposed on at least one surface of the fabric substrate 102 to cover at least a part of the fabric substrate 102. Preferably, the outer conductive structure 106 may directly contact a wearer's skin, and its pattern may be adjusted according to products or to process requirements, and is not limited to the patterns as shown in FIG. 1.

The above-described fabric substrate 102 is selected from a fabric (for example, a knitting fabric or a weaving fabric) or a non-woven fabric or a felt, and its material may be an artificial fiber or a natural fiber but is not limited to these.

Preferably, the textile substrate 102 may be a weaving fabric made of artificial fibers to provide better breathability and comfort.

The composition of the outer conductive structure 106 may include polymeric materials and conductive particles, and the polymeric materials preferably are adhesive polymeric materials. More specifically, the polymeric material is selected from polyurethane (PU), silicone, polyethylene terephthalate (PET), polyacrylate or the combinations thereof, but not limited thereto. The conductive particles include, but not limited to, metal materials, non-metal materials or the combinations thereof. The metal materials include, but not limited to, gold, silver, copper, and metal oxides (e.g. indium tin oxide (ITO)) or the combinations thereof. The non-metal materials include, but not limited to, carbon nanotubes (CNT), carbon black, carbon fiber, graphene and a conductive polymer (e.g. poly(3,4-ethylenedioxythiophene) (PEDOT), polyacrylonitrile (PAN)) or the combinations thereof. Preferably, the polymeric material and the conductive particles applicable in this embodiment are selected from polyurethane and nano-carbon materials (for example, carbon nanotubes, carbon fibers or graphene).

Figure 2:
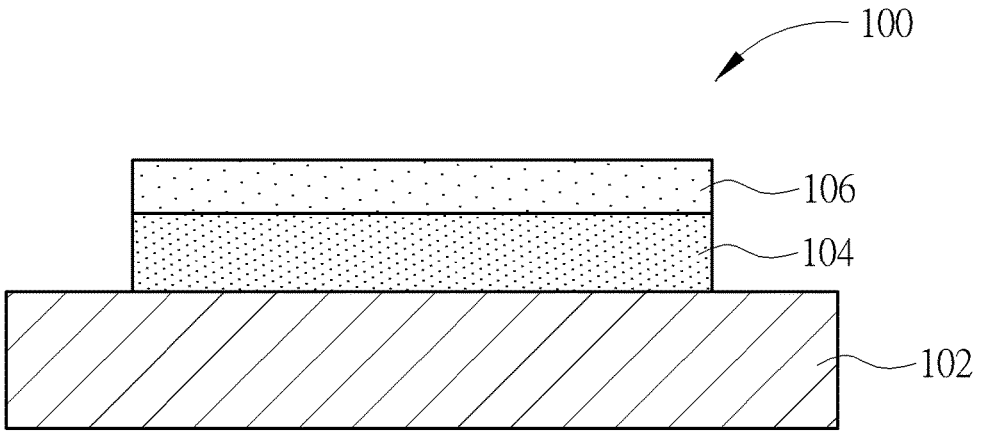
FIG. 2 is a cross-sectional view along the line A-A' in FIG. 1 in accordance with the first embodiment of the present invention.

FIG. 2 is a cross-sectional view along the line A-A' illustrated in FIG. 1 in accordance with the first embodiment of the present invention. As shown in FIG. 2, an inner conductive structure 104 is additionally disposed under the outer conductive structure 106 so that the outer conductive structure 106 can be electrically connected to the inner conductive structure 104. Further, the inner conductive structure 104 may be disposed between the fabric substrate 102 and the outer conductive structure 106, or at least partially embedded in the fabric substrate 102. In addition, the contour of the inner conductive structure 104 from the top view is preferably the same as the contour of the outer conductive structure 106 from the top view, but the contours of the two from the top view may also be adjusted according to products or to process requirements. For example, the size of the inner conductive structure 104 from the top view may be smaller than the size of the outer conductive structure 106 from the top view, such that the top surface and the side surfaces of the inner conductive structure 104 may be completely covered by the outer conductive structure 106.

The composition of the inner conductive structure 104 also includes a polymeric material and conductive particles, and is preferably the same as the composition, ingredients and types of the outer conductive structure 106 so that the composition proportions between the two may be distinctively different. For example, the concentration of the conductive particles of the inner conductive structure 104 is preferably higher than the concentration of the conductive particles of the outer conductive structure 106, such that the sheet resistance (ohms per square) of the inner conductive structure 104 is lower than the sheet resistance of the outer conductive structure 106.

In addition, when the value of the sheet resistance and the comfort of the wearers are taken into consideration, the thicknesses of the inner conductive structure 104 and the outer conductive structure 106 (including the portion which is embedded in the fabric substrate 102) may be approximately 10 μm-30 μm, respectively. In addition, when the polymeric material is selected from polyurethane and the conductive particles are selected from the nano-carbon materials respectively, the concentration of the nano-carbon materials in the inner conductive structure 104 is preferably between 10% and 30%, and the concentration of the nano-carbon materials in the outer conductive structure 106 is preferably between 1% and 10%. If the value falls outside of these ranges, the surface resistance of the textile 100 may be increased (for example, the surface resistance >100 ohms per square) and/or the washability of the textile 100 may be reduced.

According to the above embodiment, because the concentration of the polymeric material of the outer conductive structure 106 is higher than the concentration of the polymeric material of the inner conductive structure 104, in a laundery procedure the outer conductive structure 106 may serve as a protection layer of the inner conductive structure 104 so that the structure and electrical properties of the inner conductive structure 104 are not deteriorated by the laundery procedure. Therefore, the total sheet resistance of the inner conductive structure 104 and the outer conductive structure 106 is still less than 100 ohms per square even after the laundery procedure. In other words, the above-mentioned textile 100 may have a better durability and have better washability as well.

The following paragraphs further describe a method of the preparation of a textile with conductive structures of the above-mentioned first embodiment. Please refer to FIG. 2, during the initial stage of the process, conductive particles are blended with a polymeric solution to obtain a first conductive coating solution. Next, an appropriate printing approach, for example, gravure printing, screen printing, relief printing, slot coating, and so forth, is used to print the first conductive coating solution on the fabric substrate 102. Next, a drying process is carried out to remove the solvent in the first conductive coating solution to obtain the inner conductive structure 104. Please note that the inner conductive structure 104 is at least partially embedded in the fabric substrate 102 so that the top surface of the inner conductive structure 104 is higher than the top surface of the fabric substrate 102. Afterwards, a second conductive coating solution is formulated and its composition is preferably the same as the composition of first conductive coating solution with the difference of a lower proportion of the conductive particles. To be continued, an appropriate printing approach is used to print the second conductive coating solution on the inner conductive structure 104. Afterwards, a drying process is carried out to remove the solvent in the second conductive coating solution to obtain the outer conductive structure 106. So far, the textile 100 with conductive structures of the present embodiment is obtained.

The above is a textile with conductive structures in accordance with the first embodiment of the present invention. However, the textile with conductive structures of the present invention is not limited to the above-described embodiment. So far, the textiles with conductive structures in accordance with other embodiments of the present invention will be described.

Figure 3:
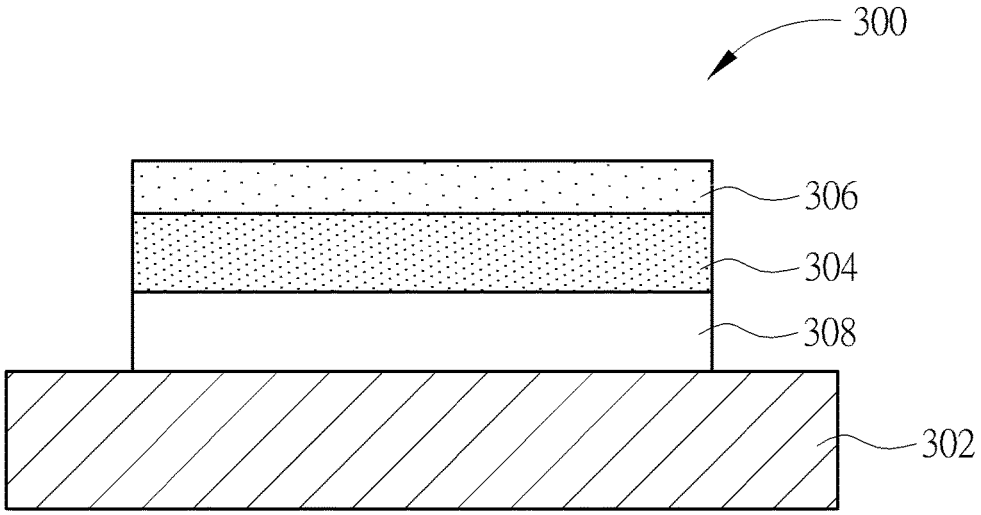
FIG. 3 is a cross-sectional view of a textile with conductive structures in accordance with the second embodiment of the present invention.

FIG. 3 is a cross-sectional view of a textile with conductive structures in accordance with the second embodiment of the present invention. Its structure generally corresponds to the line A-A' shown in FIG. 1. As shown in FIG. 3, the textile 300 also has a fabric substrate 302, an inner conductive structure 304, and an outer conductive structure 306 similar to those in the first embodiment described above. The main difference between the present embodiment and the previous embodiment is that an adhesive layer 308 is additionally provided between the fabric substrate 302 and the inner conductive structure 304 in order to fix the inner conductive structure 304 on the fabric substrate 302. The adhesive layer 308 is preferably a polymeric material, preferably a thermoplastic polymeric material, and may be selected from ethylene/ethylene vinyl acetate (EVA), polyurethane, silicone, polyethylene terephthalate, acrylate, or the combinations thereof but not limited thereto.

Further, the preparation of the textile 300 in the second embodiment is similar to the preparation of the textile 100 in the first embodiment and the main difference is that the second conductive coating solution (with a lower proportion of conductive particles) and the first conductive coating solution (with a higher proportion of conductive particles) are sequentially coated on a release paper and dried off to form a structure of double-layer conductive patterns on the release paper. Next, with the help of the adhesive layer 308, the conductive patterns on the release paper are then transferred onto the fabric substrate 302 to obtain the textile 300 with conductive structures of the present embodiment.

Figure 4:
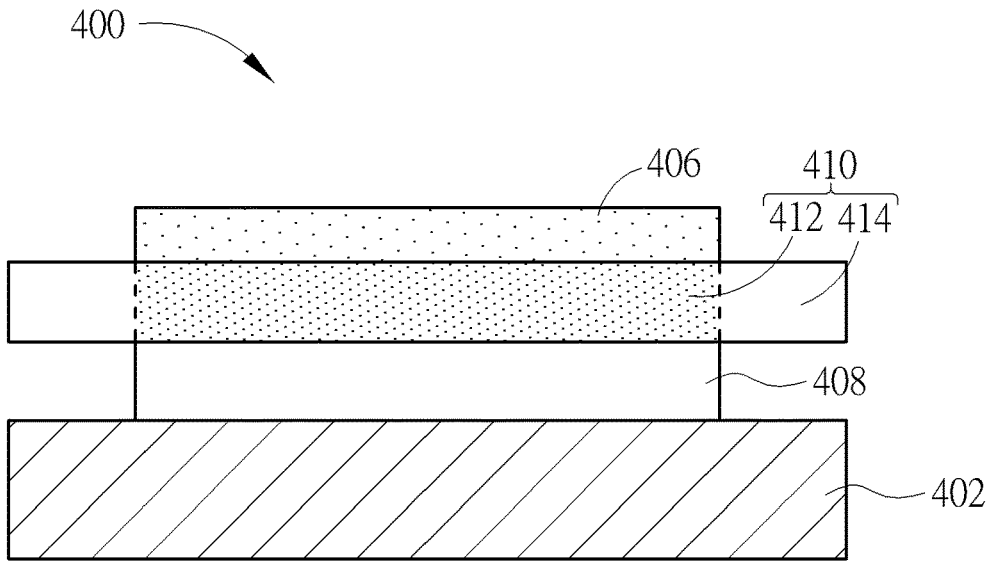
FIG. 4 is a cross-sectional view of a textile with conductive structures in accordance with the third embodiment of the present invention.

FIG. 4 is a cross-sectional view of a textile with conductive structures in accordance with the third embodiment of the present invention. Its structure generally corresponds to the line A-A' shown in FIG. 1. As shown in FIG. 4, the textile 400 has a fabric substrate 402, an inner conductive structure 412, and an outer conductive structure 406 similar to those in the first embodiment described above, and the main difference between the two is that an adhesive layer 408 is additionally provided between the fabric substrate 402 and the inner conductive structure 412 in order to fix the inner conductive structure 412 on the fabric substrate 402. Besides, the inner conductive structure 412 is disposed in a conductive fabric layer 410 so that the conductive fabric layer 410 may include the inner conductive structure 412 and an insulating pattern structure 414.

The above adhesive layer 408 is preferably a polymeric material, more preferably a thermoplastic polymeric material, and may be selected from ethylene/ethylene vinyl acetate (EVA), polyurethane, silicone, polyethylene terephthalate, acrylate, or the combinations thereof but not limited thereto. The above conductive fabric layer 410 may be selected from a fabric with conductive fibers (for example, a knitting fabric or a weaving fabric) or a non-woven fabric or a felt, and its material may be an artificial fiber or a natural fiber but is not limited thereto. Preferably, the conductive fabric layer 410 is a weaving fabric made of artificial fibers and its conductive region is made of conductive fibers.

Further, the preparation of the textile 400 in the third embodiment is as follows. First, a conductive coating solution is formulated. Its composition is similar to the second conductive coating solution of the first embodiment. Next, an appropriate printing approach is used to print the second conductive coating solution on the conductive fabric layer 410 so that the second conductive coating solution may overlap the conductive pattern in the conductive fabric layer 410, or is even embedded in the conductive fabric layer 410. Next, a drying process is carried out to remove the solvent in the second conductive coating solution to obtain the outer conductive structure 406. At last, with the help of the adhesive layer 408, the conductive fabric layer 410 is then transferred onto the fabric substrate 402 to obtain the textile 400 with conductive structures of the present embodiment.

Figure 5:
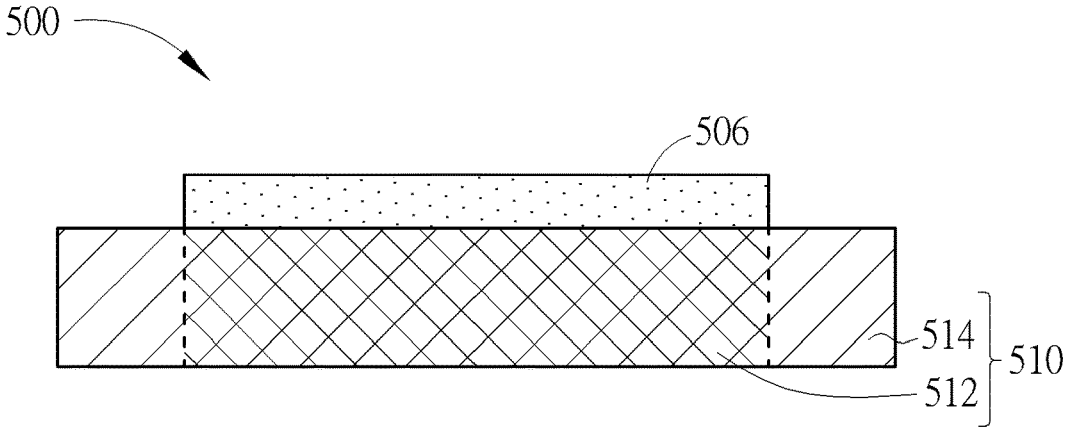
FIG. 5 is a cross-sectional view of a textile with conductive structures in accordance with the fourth embodiment of the present invention.

FIG. 5 is a cross-sectional view of a textile with conductive structures in accordance with the fourth embodiment of the present invention. Its structure generally corresponds to the line A-A' shown in FIG. 1. As shown in FIG. 5, the textile 500 has a fabric substrate 510, an inner conductive structure 512 and an outer conductive structure 506 similar to those in the first embodiment described above. The main difference between the two is that the inner conductive structure 512 is completely embedded in the fabric substrate 510 so that the inner conductive structure 512 and an insulating pattern structure 514 are included in the fabric substrate 510.

Further, the preparation of the textile 500 in the fourth embodiment is similar to the first embodiment and the main difference is that a first conductive coating solution is coated on the fabric substrate 510, then the correspondingly formed inner conductive structure 512 is completely embedded in the fabric substrate 510 after a drying process so that the top side of the inner conductive structure 512 is coplanar with the top side of the fabric substrate 510 (or of the insulating pattern structure 514). Other preparations in this embodiment are similar to the preparations in the above-mentioned first embodiment.

In order to make one of ordinary skill in the art enable the practice of the present invention, various examples of the present invention will be further elaborated in details in the following paragraphs. It should be noted that the following examples are for illustrative purposes only and should not be construed to limit the present invention. That is, a material, the amount of a material and a ratio as well as a processing flow in the respective examples may be appropriately modified without exceeding the scope of the present invention.

The following is information of a list of abbreviation for each chemical material used in the following examples as well as its source, and the required instruments:

Polyurethane: CD-5030, YamaKen, the solid content 30 wt. %, and n-Butylacetate (nBAC) as the solvent.

Nano-carbon materials: MWCNT-01, EMAXWIN TECHNOLOGY.

Hot melt adhesive strips: UH-203, CHUNG THAI PAPER.

Screen for screen printing: Tetoron, Chi Long Technology.

Laser cutting machine: HE-9060, HongWei Optics.

Hot presser: HA-860A, JIIN YANG TRADING.

Surface resistance meter with four-point probe: SRM-8809A, FOREFAR TECHNOLOGY.

Plain weaving fabrics: Everest Textile Co., Ltd., 30 denier plain weaving fabrics.

Conductive plain weaving fabrics: 30FCT, U-TEK EMI.

Example 1

(1) 1 part by weight of nano-carbon materials (CNTs) was added to 7.8 parts by weight of polyurethane (the solid content of the carbon nanotubes was 30 wt. %), and the two were uniformly mixed to obtain a conductive coating solution, which is abbreviated as S1. Afterwards, the conductive coating solution was printed on a weaving fabric with a 200 mesh screen by a screen-printing technique. Following the application of hot air drying, the weaving fabric which was coated with the conductive coating solution was dried by hot air at 150° C. for 3 minutes to remove the solvent in the conductive coating solution to form an inner conductive structure which was partially embedded in the plain weaving fabric. The overall average thickness of the inner conductive structure was approximately 20 μm (including the thickness which was embedded in the weaving fabric and protruding from the weaving fabric).

(2) 1 part by weight of the nano-carbon materials was added to 63.3 parts by weight of polyurethane (the solid content of the carbon nanotubes was 5 wt. %), and the two were uniformly mixed to obtain a conductive coating solution, which is abbreviated as S2. Afterwards, the conductive coating solution was printed on a weaving fabric which had been processed in step (1) with a screen of 200 mesh by a screen-printing technique so that the conductive coating solution was stacked on the inner conductive structure. Following the application of hot-air drying, the weaving fabric with the conductive coating solution was dried by hot air at 150° C. for 3 minutes to remove the solvent in the conductive coating solution to form an outer conductive structure which was stacked on the inner conductive structure. The overall average thickness of the outer conductive structure was approximately 20 μm. So far, a textile with conductive structures of Example 1 was obtained, and its structure may roughly correspond to the structure as shown in FIG. 2.

(3) The surface resistance of the textiles with conductive structures was measured by using a surface resistance meter with four-point probe, and the results are shown in Table 1.

(4) The above textile with conductive structures were treated according to AATCC 135 established by American Association of Textile Chemists and Colorists (AATCC) and the surface resistance of the textiles with conductive structures after the treatment were measured by using a surface resistance meter with four-point probe, and the results are shown in Table 1.

Example 2

(1) The conductive coating solution as described in step (2) of Example 1 was formulated and abbreviated as S2. Afterwards, the conductive coating solution was printed on a release paper with a 200 mesh screen by a screen printing technique. Following the application of hot air drying, the weaving fabric coated with the conductive coating solution was dried by hot air at 150° C. for 3 minutes to remove the solvent in the conductive coating solution to obtain a bottom conductive structure. The overall average thickness of the bottom conductive structure is approximately 20 μm.

(2) The conductive coating solution as described in step (1) of Example 1 was formulated and abbreviated as S1. Afterwards, the conductive coating solution was printed on the bottom conductive structure with a 200 mesh screen by a screen printing technique. Following the application of hot air drying, the release paper coated with the conductive coating solution was dried by hot air at 150° C. for 3 minutes to remove the solvent in the conductive coating solution to form a top conductive structure. The top conductive structure was stacked on the bottom conductive structure to form a stack conductive structure.

(3) A hot melt adhesive strip was disposed on a weaving fabric, and the stack conductive structure was transferred onto the weaving fabric by the hot melt adhesive strip. So far, a textile with conductive structures of Example 2 was obtained, and its structure may roughly correspond to the structure as shown in FIG. 3. The top conductive structure and the bottom conductive structure may correspond to the inner conductive structure 304 and the outer conductive structure 306, respectively.

(4) The step (3) and step (4) in Example 1 were repeated, and the results are shown in Table 1.

Example 3

The steps (1)-(4) in Example 2 were repeated, however, the hot melt adhesive strip in step (3) was replaced with polyurethane. So far, the textile with conductive structures of Example 3 was obtained, and its structure may roughly correspond to the structure as shown in FIG. 3. The results are shown in Table 1.

Example 4

(1) The step (2) in Example 1 was repeated. However, the conductive coating solution (S2) was coated on a conductive weaving fabric with conductive fibers. The conductive fibers have a conductive pattern, and the conductive coating solution (S2) was coated on the conductive pattern.

(2) The hot melt adhesive strip was disposed on the weaving fabric, and the conductive weaving fabric which had been treated in the step (1) was transferred onto the weaving fabric by the hot melt adhesive strip. So far, the textile with conductive structures of Example 4 was obtained, and its structure roughly corresponds to the structure as shown in FIG. 4.

(3) The steps (3) and (4) in Example 1 were repeated, and the results are shown in Table 1.

Example 5

The steps (1)-(4) in Example 1 were repeated, but the composition of the conductive coating solution (S1) in the step (1) of Example 1 was replaced with 1 part by weight of nano-carbon materials and with 30 parts by weight of polyurethane (the solid content of the carbon nanotubes was 10 wt. %). The results are shown in Table 1.

Example 6

The steps (1)-(4) in Example 1 were repeated, but the composition of the conductive coating solution (S1) in the step (1) of Example 1 was replaced with 1 part by weight of nano-carbon materials and with 13.3 parts by weight of polyurethane (the solid content of the carbon nanotubes was 20 wt. %). The results are shown in Table 1.

Comparative Example 1

(1) The step (1) in Example 1 was repeated. The 200 mesh screen was replaced with a 150 mesh screen, and the composition of the conductive coating solution (S1) was replaced with 1 part by weight of nano-carbon materials and with 13.3 parts by weight of polyurethane (the solid content of the carbon nanotubes was 20 wt. %) to obtain the textile with a single layer conductive structure.

(2) The steps (3) and (4) in Example 1 were repeated, and the results are shown in Table 1.

Comparative Example 2

The steps (1)-(4) in Example 1 were repeated. The 200 mesh screen in step (1) of Example 1 was replaced with a 150 mesh screen, and the composition of the conductive coating solution (S2) in step (2) was replaced with 1 part by weight of nano-carbon materials and with 30 parts by weight of polyurethane (the solid content of the carbon nanotubes was 10 wt. %). The results are shown in Table 1.

Comparative Example 3

The steps (1)-(4) in Example 1 were repeated. The composition of the conductive coating solution (S1) in step (1) of Example 1 was replaced with 1 part by weight of nano-carbon materials and with 7.08 parts by weight of polyurethane (the solid content of the carbon nanotubes was 32 wt. %). The results are shown in Table 1.

Comparative Example 4

The steps (1)-(4) in Example 1 were repeated. The composition of the conductive coating solution (S2) in step (2) of Example 1 was replaced with 1 part by weight of nano-carbon materials and with 330 parts by weight of polyurethane (the solid content of the carbon nanotubes was 1 wt. %). The results are shown in Table 1.

TABLE 1

| | Outer conductive structure | Inner conductive structure | Sheet resistance before laundery (ohms per square) | Sheet resistance after laundery (ohms per square) |
|---|---|---|---|---|
| Example 1 | 5 wt. % CNTs | 30 wt. % CNTs | 53 | 56 |
| Example 2 | 5 wt. % CNTs | 30 wt. % CNTs | 54 | 55 |
| Example 3 | 5 wt. % CNTs | 30 wt. % CNTs | 55 | 56 |
| Example 4 | 5 wt. % CNTs | Conductive weaving fabric | 51 | 66 |
| Example 5 | 5 wt. % CNTs | 10 wt. % CNTs | 88 | 93 |
| Example 6 | 5 wt. % CNTs | 20 wt. % CNTs | 69 | 74 |
| Comparative Example 1 | 20 wt. % CNTs | — | 52 | 116 |
| Comparative Example 2 | 10 wt. % CNTs | 30 wt. % CNTs | 48 | 109 |
| Comparative Example 3 | 5 wt. % CNTs | 32 wt. % CNTs | 50 | 103 |
| Comparative Example 4 | 1 wt. % CNTs | 30 wt. % CNTs | 114 | 117 |

According to the results as shown in Table 1, when the textiles have double-layer conductive structures (i.e. in Examples 1-6), the values of the surface resistance (i.e. the overall sheet resistance of the entire double-layer conductive structures) even after a laundery procedure or the changes (before and after the laundery procedure) of the surface resistance are still smaller than the textiles with only single layer conductive structures (i.e. in the Comparative Examples 1-4). In other words, the textiles with double-layer conductive structures may have a higher degree of washability and accordingly their durability can be greatly improved, so they are suitable for use in the field of wearable devices.

In addition to being used in the sensing field, the above-mentioned textiles with double-layer conductive structures may also be applied in the field of electrotherapy. More specifically, the conventional electrotherapy uses electrode pads with gel coated on their surfaces and they are attached to the skin. These electrode pads are electrically connected to an electrostimulator (for example, iLOVE Digital Tens (UC-332) from UNION COMMONWAY INTL.). By using the electrostimulator to output electrical currents of different frequencies to the electrode pads, it aims for the purposes such as, to help muscle contract or to prevent muscular atrophy. The main effects of the electrotherapy reside in alleviating pain, increasing the strength of muscles, slowing down or avoiding muscular atrophy, alleviating a muscular spasm and increasing the blood circulation in the skin. Further, if the peripheral nerves still have functions, it may achieve the functions such as muscle contraction by stimulating the peripheral nerves. However, if the peripheral nerves have been impaired, the muscles have to be directly stimulated to achieve muscle contraction and to prevent the muscular atrophy.

However, since the conventional therapeutic electrode pads for the electrotherapy are individually provided outside of the textile, they are not convenient to use. In contrast, the double-layer conductive structures of the present invention are integrated within the textiles and they can form the conductive patterns of specific shapes in the textiles by coating. In other words, the electrical currents which are output from the electrostimulator can be transmitted to a specific area on the skin through these conductive patterns, and the electrotherapy can be exclusively performed only on this area so that the electrotherapy can be performed much more easily.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A textile with conductive structures, comprising:

a fabric substrate;

an outer conductive structure disposed on the fabric substrate and comprised a polymer; and an inner conductive structure disposed under the outer conductive structure and electrically connected to the outer conductive structure, wherein a sheet resistance (ohms per square) of the inner conductive structure is lower than the sheet resistance of the outer conductive structure, and a total sheet resistance of the inner conductive structure and the outer conductive structure is less than 100 ohms per square after the textile undergoes a laundery procedure, and the inner conductive structure comprises another polymer;

wherein a concentration of the polymer of the outer conductive structure is higher than a concentration of the polymer of the inner conductive structure.

2. The textile with conductive structures of claim 1, wherein the inner conductive structure and the outer conductive structure further comprise a plurality of conductive particles.

3. The textile with conductive structures of claim 2, wherein the polymer is polyurethane (PU) and the conductive particles are nano-carbon materials.

4. The textile with conductive structures of claim 2, wherein a concentration of the conductive particles in the inner conductive structure is higher than the concentration of the conductive particles in the outer conductive structure.

5. The textile with conductive structures of claim 2, wherein a concentration of the conductive particles in the outer conductive structure is between 1 wt. % and 10 wt. % (1 wt. %< the concentration <10 wt. %) and the concentration of the conductive particles in the inner conductive structure is between 10 wt. % and 30 wt. % (10 wt. %< the concentration ≤30 wt. %).

6. The textile with conductive structures of claim 1, wherein the inner conductive structure is embedded in the fabric substrate.

7. The textile with conductive structures of claim 1, further comprising an adhesive layer disposed between the inner conductive structure and the fabric substrate.

8. The textile with conductive structures of claim 1, wherein the inner conductive structure is a conductive fabric.

9. The textile with conductive structures of claim 1, wherein the outer conductive structure directly contacts a human's skin.

10. The textile with conductive structures of claim 1, further comprising a fabric layer which is disposed between the fabric substrate and the outer conductive structure, and the inner conductive structure is embedded in the fabric layer.

* * * * *